US006652309B2

(12) United States Patent
Sukagawa

(10) Patent No.: US 6,652,309 B2
(45) Date of Patent: Nov. 25, 2003

(54) CONNECTOR

(75) Inventor: Susumu Sukagawa, Tokyo (JP)

(73) Assignee: Leisure Electronics Technology Co., Ltd., Tokyo (JP)

( * ) Notice: Subject to any disclaimer, the term of this patent is extended or adjusted under 35 U.S.C. 154(b) by 0 days.

(21) Appl. No.: 10/188,312

(22) Filed: Jul. 3, 2002

(65) Prior Publication Data

US 2003/0022547 A1 Jan. 30, 2003

Related U.S. Application Data

(63) Continuation of application No. 09/756,707, filed on Jan. 10, 2001, now abandoned.

(30) Foreign Application Priority Data

Jun. 16, 2000 (JP) ..... 2000-181534

(51) Int. Cl.[7] ..... H01R 13/64
(52) U.S. Cl. ..... 439/376; 439/342
(58) Field of Search ..... 439/377, 376, 439/342, 345, 660, 259, 332, 352, 343, 346, 676

(56) References Cited

U.S. PATENT DOCUMENTS 3,744,009 A * 7/1973 Teagno et al. ..... 439/345
4,498,719 A * 2/1985 Juris et al. ..... 439/376
4,838,806 A * 6/1989 Igarashi ..... 439/376
5,249,987 A * 10/1993 Kristiansen ..... 439/676
5,772,459 A * 6/1998 Swart ..... 439/376
5,879,196 A * 3/1999 Lee ..... 439/660
6,036,549 A * 3/2000 Wulff ..... 439/660

* cited by examiner

*Primary Examiner*—Renee Luebke
*Assistant Examiner*—Felix O. Figueroa
(74) *Attorney, Agent, or Firm*—Jacobson Holman PLLC

(57) ABSTRACT

The object of the present invention to provide a connector, or a male-female engagement type connector set to be more precise, wherein the contact section of the female connector is invisible from the outside through its insertion opening. According to the invention, the above object is achieved by providing a connector with a housing member (10) made of an insulating material and having an engagement space for receiving a matching connector (3) inserted through an insertion opening (11) formed at the front end. A contact member (1) is fitted to the housing member (10) and has a contact section **(23*a*) arranged in the engagement space (12). The engagement space (12) is formed internally relative to the insertion opening (11) so as to spread toward the outer periphery of the housing section. The contact section (23*a*) is arranged in the engagement space (12) at a position shifted toward the outer periphery so as to be invisible from the front side of the insertion opening (11). The housing member (10) is provided with a guide section (14) for guiding the matching connector (3*a*) inserted into the engagement space (12) through the insertion opening (11) to move toward and adjoin the contact section (23*a*)**.

16 Claims, 10 Drawing Sheets

CONNECTOR

This application is a Continuation of application Ser. No. 09/756,707 filed Jan. 10, 2001, now abandoned.

DESCRIPTION OF THE RELATED BACKGROUND ART

Electric connectors are indispensable to almost all electric appliances and they are used for connecting power lines and electric signals as well as for various other purposes. While many electric connectors are constantly connecting signal lines, some are used only when necessary for connecting testers, sensors, inspection gauges and so on. For instance, the substrate of an IC chip may be proved with a female connector arranged on the substrate thereof and designed for connecting an inspection gauge so that the matching male connector of the inspection gauge may be connected to the female connector to check the performance of the IC chip.

Conventionally, most male-female engagement type connectors are so configured that the male connector is inserted straight into the engagement space of the housing of the female connector until the front contact section of the male connector comes to contact with the corresponding contact section of the female connector. Therefore, when viewed from the outside of the insertion opening of the female connector, the contact section of the female connector may appear as if it is projecting toward the insertion opening. With such an arrangement, the front contact section of the male connector adojoins the contact section of the female connector projecting toward the insertion opening and pushes it out toward the outer periphery of the connector housing to establish a reliable electric connection between the two contact sections simply by inserting the front end of the male connector straight rough the insertion opening.

With a conventional male-female engagement type connector set whose male and female connectors are connected to each other only for inspection or some other purpose, the female connector to be connected to an inspection gauge is normally left unconnected to the male connector and hence the insertion opening of the female connector remains open. Then, since the contact section of the female connector of the conventional male-female engagement type connector set appears to be projecting toward the insertion opening in the engagement space of the housing of the female connector, if the user mistakenly inserts a metal rod such as a screw driver into the engagement space through the insertion opening, the front end of the metal rod can touch the contact section of the female connector to give rise to short-circuiting and/or grounding on the part of the contact section and consequently adversely affect any of the electronic components arranged on the substrate and connected to female connector.

In view of the above described circumstances, it is therefore the object of the present invention to provide a connector, or a male-female engagement type connector set to be more precise, wherein the contact section of the female connector is invisible from the outside through its insertion opening.

SUMMARY OF THE INVENTION

According to the invention, the above object is achieved by providing a connector comprising:

a housing member made of an insulating material and having an engagement space for receiving a matching connector inserted through an insertion opening formed at the front end thereof;

a contact member fitted to the housing member and having a contact section arranged in the engagement space;

said engagement space being formed internally relative to the insertion opening so as to spread toward the outer periphery of the housing section;

said contact section being arranged in the engagement space at a position shifted toward the outer periphery so as to be invisible from the front side of the insertion opening; and said housing member being provided with a guide section for guiding the matching connector inserted into the engagement space through the insertion opening to move toward and adojoin the contact section.

With a connector according to the invention, since the contact section is arranged in the engagement space at a position shifted toward the outer periphery so as to be invisible from the front side of the insertion opening, if the user inserts by mistakes a screw driver through the insertion opening, the front end of the screw driver would not touch the contact section of the female connector to adversely affect any of the electronic components arranged on the substrate. When the contact section is arranged at a position shifted toward the outer periphery so as to be invisible from the front side of the insertion opening, it may be difficult for the matching connector (male connector) to adjoin the contact section if the matching connector is inserted straight into the engagement space. However, since a connector according to the invention is provided with a guide section for guiding the matching connector inserted into the engagement space through the insertion opening to move toward and adjoin the contact section, the contact section of the matching connector can reliably join its counterpart of the connector according to the invention to establish a reliable electric connection therebetween simply by inserting the matching connector into the engagement space through the insertion opening.

Preferably, a connector according to the invention further comprises a holding section for holding the matching connector inserted into the engagement space of the housing member to a state moved toward the contact section thereof. Then, the contact section of the matching connector can reliably join its counterpart of the connector according to the invention to establish a reliable electric connection therebetween simply by inserting the matching connector into the engagement space through the insertion opening and, at the same time, maintain the electrically connected state due to the provision of the holding section.

In another aspect of the invention, provided is a male-female engagement type connector set comprising:

a male connector having a male contact member provided with a contact section and held in a male housing member with said contact section exposed at the front end thereof, a female connector having a female housing member made of an insulating material and provided with an engagement space for receiving said front end of said male connector inserted through an insertion opening formed at the front end thereof and a female contact member fitted to said female housing with a female contact section arranged in said engagement space;

said engagement space being formed internally relative to said insertion opening so as to spread toward the outer periphery of said female housing member;

said contact section being arranged in said engagement space at a position shifted toward the outer periphery so as to be invisible from the front side of the insertion opening;

said female housing member being provided with a guide section for guiding the front end of said male connector inserted into the engagement space through the insertion opening to move toward said female contact section and cause said male contact section to abut the corresponding female contact section;

said male connector having said front end portion adapted to be inserted into said engagement space, a neck portion extending from said front end and a base portion extending from said neck; and said male connector being profiled so as to make said neck portion to be located in said insertion opening and said front end portion to be free from obstruction in the movement of being inserted into said engagement space and guided by said guide section toward said female contact section.

With a male-female engagement type connector set according to the invention, since the female contact section is arranged in the engagement space at a position shifted toward the outer periphery so as to be invisible from the front side of the insertion opening, if the user inserts by mistake a screw driver through the insertion opening, the front end of the screw driver would not adojoin the female contact section to adversely affect any of the electronic components arranged on the substrate to which the female connector is fitted. When the female contact section is arranged at a position shifted toward the outer periphery so as to be invisible from the front side of the insertion opening, it may be difficult for the contact section of the matching connector (male connector) to adojoin the corresponding respective female contact section if the matching connector is inserted straight into the engagement space. However, since a male-female engagement type connector set according to the invention is provided with a guide section for guiding the front end of the male connector inserted into the engagement space through the insertion opening so as to make it move toward and adojoin the female contact section, the contact section of the male connector can reliably join its counterpart of the female connector to establish a reliable electric connection therebetween simply by inserting the male connector into the engagement space through the insertion opening.

Preferably, a male-female engagement type connector set according to the invention further comprises a holding section arranged in the female housing member for holding the front end portion of the male connector inserted into the engagement space of the housing member to a moved state toward the female contact section. Then, the contact section of the male connector can reliably be moved toward and adjoin its counterpart of the female connector to establish a reliable electric connection therebetween simply by inserting the male connector into the engagement space through the insertion opening and, at the same time, maintain the electrically connected state due to the provision of the holding section.

Preferably, a male-female engagement type connector set according to the invention further comprises a lock means for locking and holding the male housing member relative to the female housing member at a position where the front end of the male connector is completely inserted into the engagement space. At the position where the front end portion of the male connector is completely inserted into the engagement space, the state in which the male contact section adjoins the corresponding female contact section to establish a reliable electric connection therebetween is maintained by the holding section. Therefore, as the male connector is locked to this position by the lock means, the state of the male connector being held by the holding section becomes further reliable. Additionally, if the locking operation of the lock means is accompanied by a feeling of click, the user can easily feel the completion of the insertion of the male connector.

Preferably, in a male-female engagement type connector set according to the invention, the male connector has a plurality of male contact members provided at the front ends thereof with respective male contact sections that are arranged transversally and exposed and the front end position of the male contact section of at least one of the male contact members is displaced from the front end position of the male contact section of the other male contact members along the direction of insertion so that the male contact members are connected with the respective female contact members with a time lag. With this arrangement, when the male connector is connected to the female connector, the grounding contact member and the power supply contact member of the male connector may be connected first with their respective counterparts of the female connector and the signal contact members of the male connector may be connected subsequently with their respective counterparts of the female connector to give rise to a time lag for electric connection. Then, any possible adverse effect of the electronic components on the related electronic connected by way of the connectors can be minimized.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
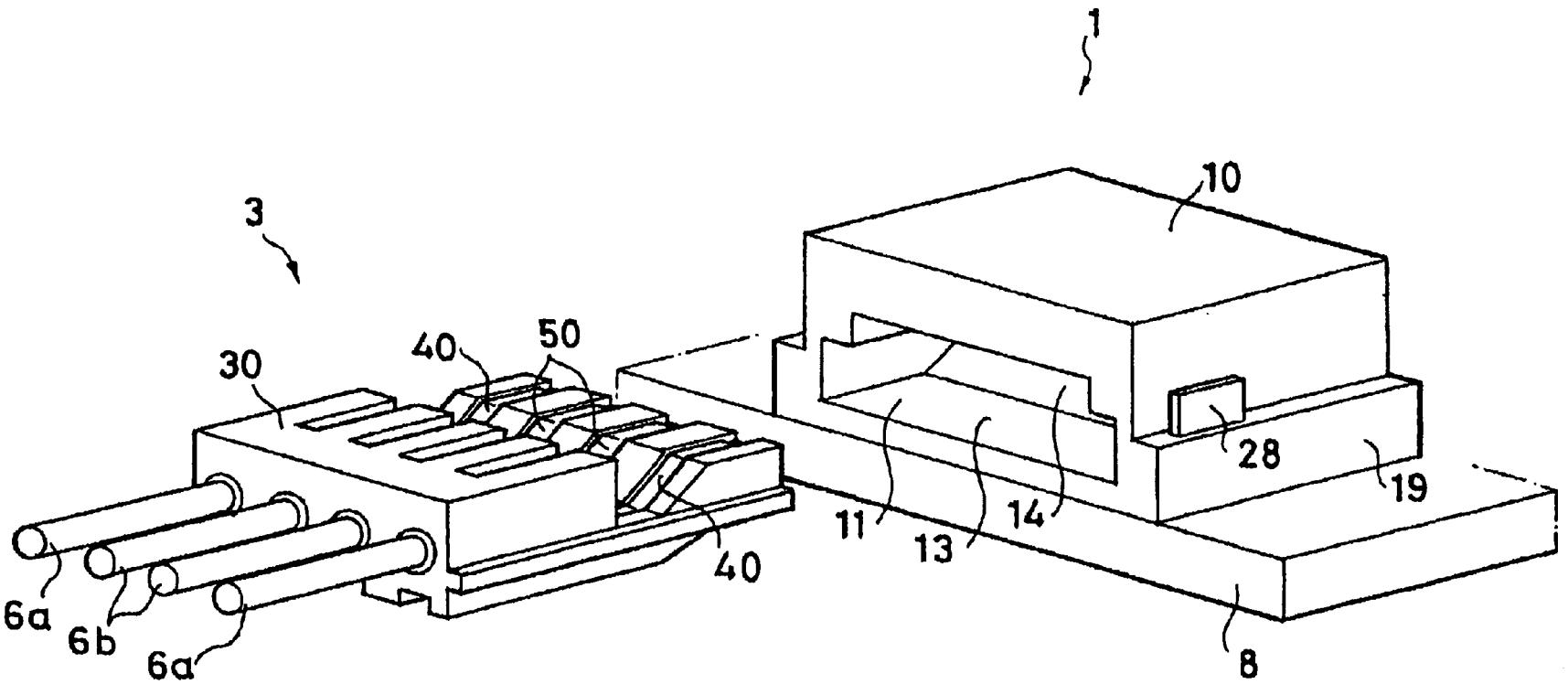
FIG. 1 is a schematic perspective view of an embodiment of male-female engagement type connector set according to the invention, showing the female connector and the male connector.

The present invention will be described in greater detail by referring to the accompanying drawings that illustrate preferred embodiments of the invention. FIG. 1 is a schematic perspective view of a first embodiment of male-female engagement type connector set according to the invention and comprising a female connector 1 and a male connector 3. The male connector 3 is connected to a plurality (four in this embodiment) of cables 6*a*, 6*a*, 6*b* and 6*b*, and the female connector 1 is fitted to a printed circuit board 8. Of the four cables connected to the male connector 3, the outer two cables 6*a* and 6*a* are power supply cables and the inner two cables 6*b* and 6*b* are signal cables. In the following description, the side of each of the connectors that faces the other connector is referred as the front side. Thus, the right side of the female connector 1 is shown as the front side in FIG. 3, whereas the left side of the male connector 3 is shown as the front side in FIG. 5.

Figure 2:
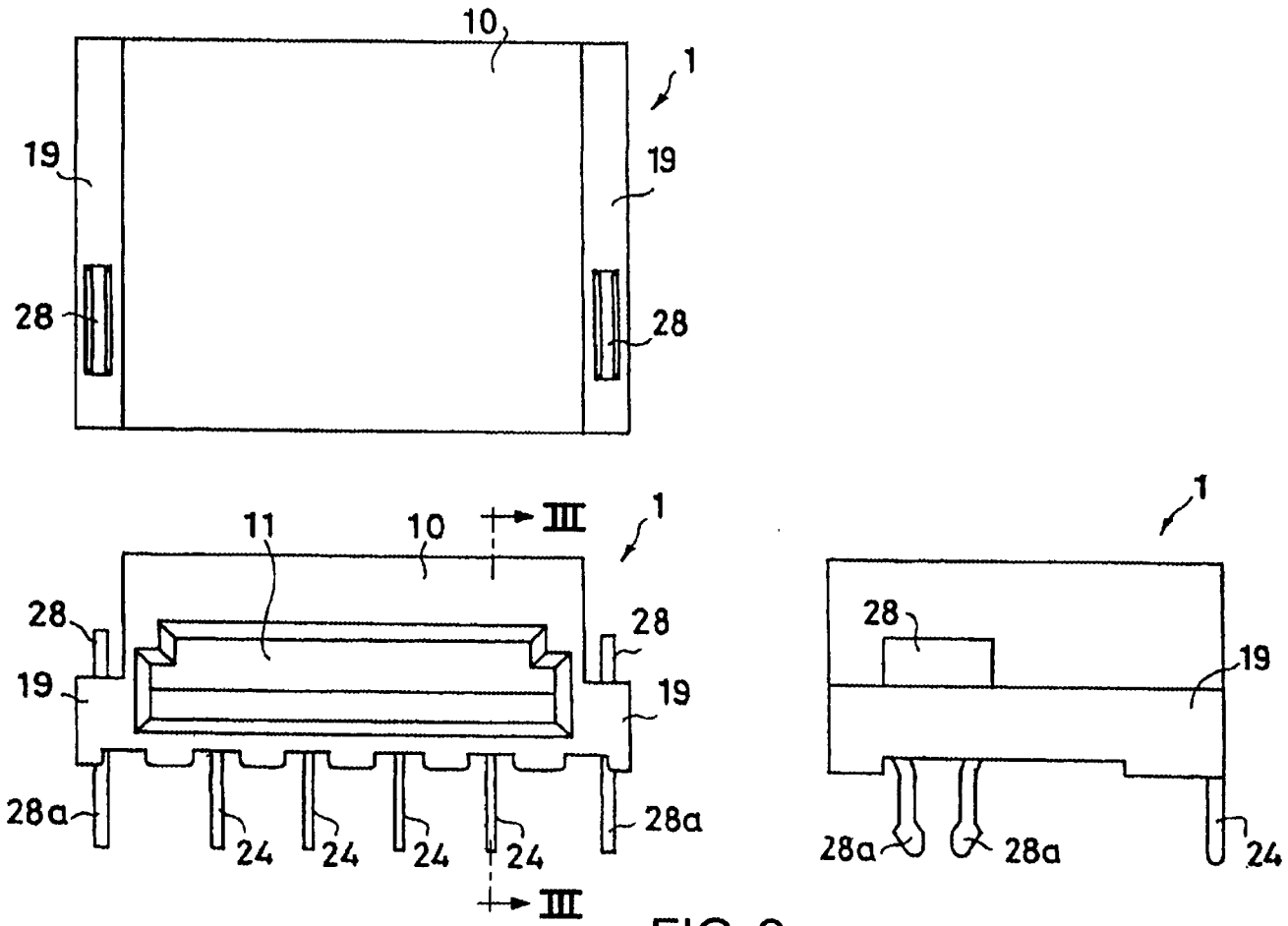
FIG. 2 is a schematic front view, a schematic plane view, and a schematic lateral view of the female connector of the embodiment of FIG. 1.

Firstly, the female connector 1 will be described by referring to FIGS. 2 and 3. The female connector 1 comprises a female housing 10 made of an insulating material and provided with an insertion opening 11 formed at the front end thereof and an engagement space 12 formed in the inside thereof, four female contacts 20, 20, 20 and 20 driven into the female housing 10 from the rear side and secured thereto and a pair of left and right anchor metal fittings 28 and 28 respectively forcibly secured to left and right stepped sections 19 and 19 of the female housing 10 so as to vertically run therethrough. The anchor metal fittings 28 and 28 have downwardly projecting respective anchor legs 28*a* and 28*a* so that the female connector 1 is secured to the printed circuit board 8 as the anchor legs 28*a* and 28*a* are inserted into respective fitting holes (not shown in the FIGS.) of the printed circuit board 8.

The top side of the engagement space 12 of the female housing 10 extends rearward above (along the outer periphery) from the insertion opening 11 so that the upper space 12*a* of the engagement space 12 extending upwardly is not visible from the front side of the insertion opening 11. The bottom side of the engagement space 12 is defined by a horizontal section 13 extending horizontally and rearward from the insertion opening 11, a guide section 14 that is a sloped surface extending aslant upwardly and rearward from the horizontal section 13 and a holding section 15 extending horizontally from the guide section 14. A pair of lock recesses 13*a* having a semispherical profile is formed on the horizontal section 13. The rear side of the engagement space 12 is defined by a vertically extending rear partition wall 16. The female housing 10 additionally comprises contact insertion holes 18, 18, 18 and 18 running from the rear side of the female housing 10 to the engagement space through the rear partition wall 16 and contact press fit holes 17, 17, 17 and 17 cut into the rear partition wall 16 from the rear side of the female housing 10.

Figure 3:
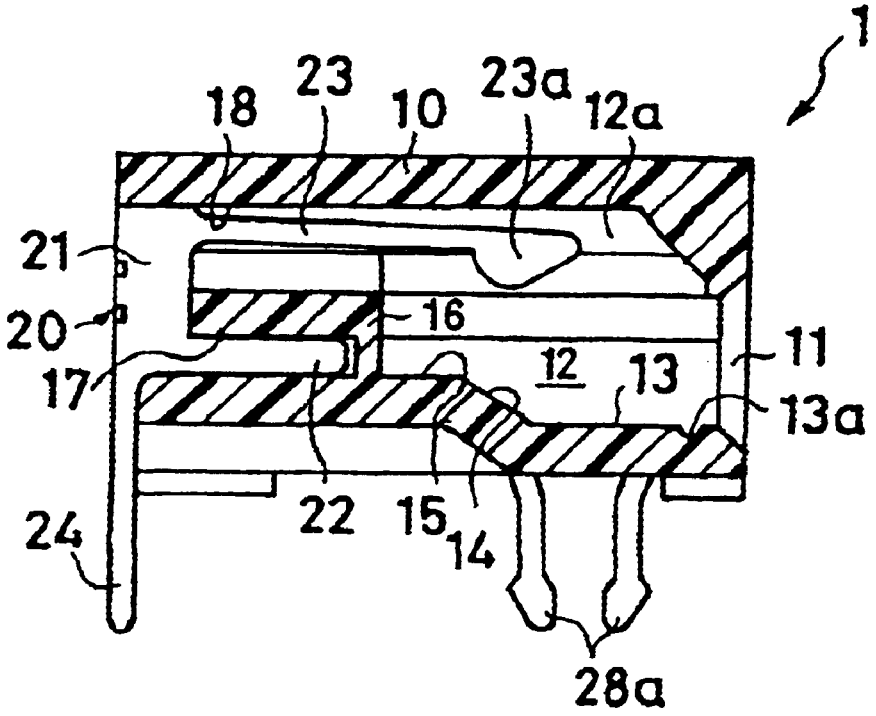
FIG. 3 is a schematic cross sectional view of the female connector of the embodiment of FIG. 1.

All the four female contacts 20, 20, 20 and 20 have the same and identical profiles as shown in FIG. 3 and are made of metal plates. Each of the female contacts 20, 20, 20 and 20 has a holding arm 22 extending forwardly from the base section 21 thereof, a contact arm 23 also extending forwardly from the base section 21 at a position above the holding arm 22 and a lead section 24 extending downwardly from the base section 21. As the holding arm 22 is press fitted into the corresponding contact press fit hole 17, the female contact 20 is fitted to the female housing 10. Then, the contact arm 23 enters the upper space 12*a* of the engagement space 12 through the contact insertion hole 18 and the lead section 24 projects downward. As a result, the female contact section 23*a* is formed at the front end of the contact arm 23 projecting into the upper space 12*a* although the female contact section 23*a* is located within the upper space 12*a* as shown in FIG. 2 so that it is located at a position that is invisible from the front side of the insertion opening 11 of the female housing 10.

Figure 4:
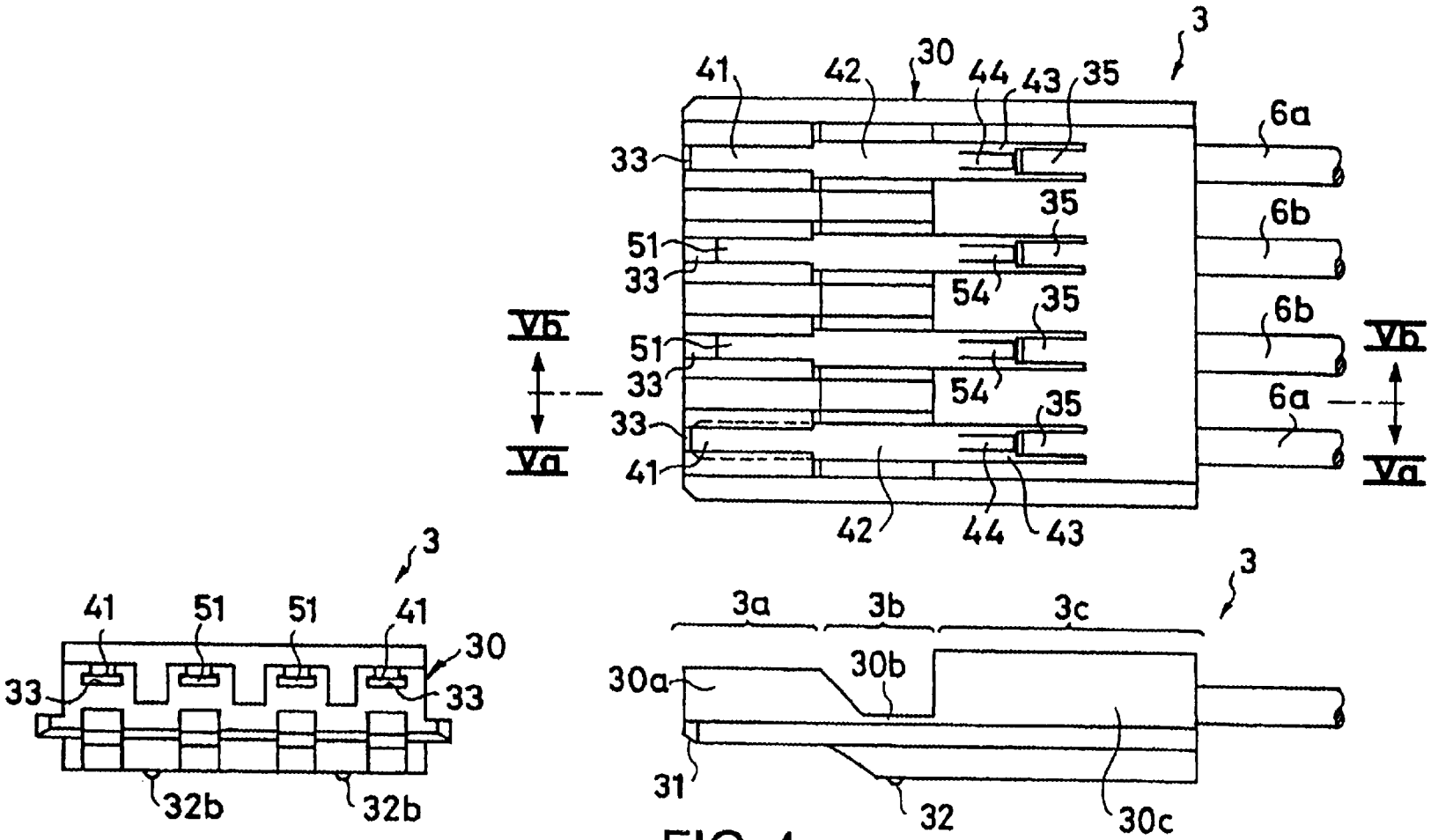
FIG. 4 is a schematic front view, schematic plan view and a schematic lateral view of the male connector of the embodiment of FIG. 1.
Figure 5A:
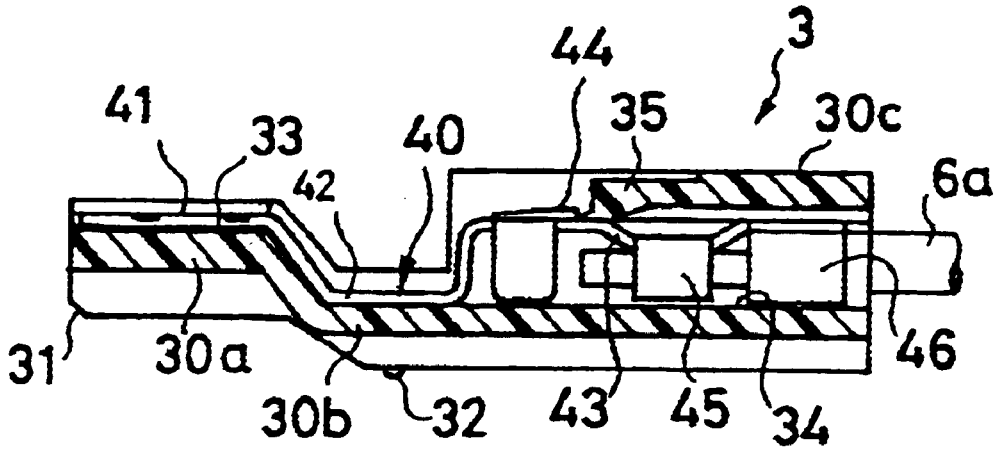
FIG. 5*a* and FIG. 5*b* are schematic cross sectional views of the male connector of the embodiment of FIG. 1.
Figure 5B:
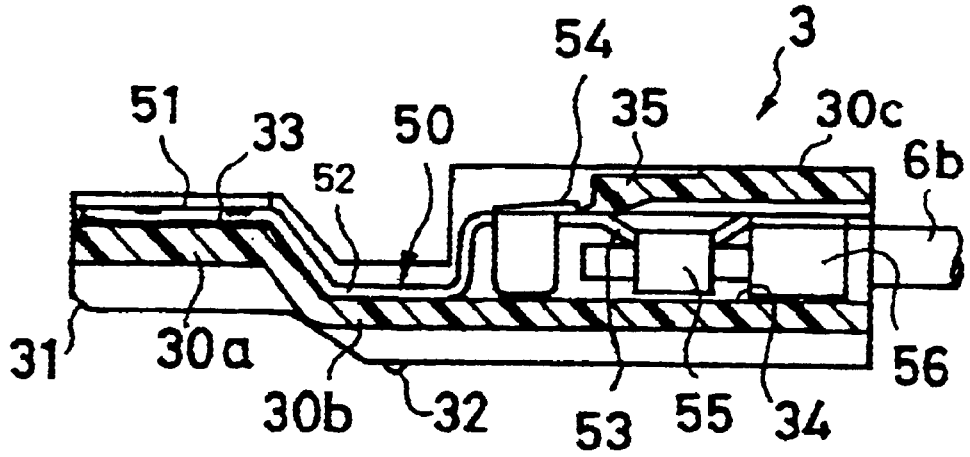

Now, the male connector 3 will be described by referring to FIGS. 4 and 5. The male connector 3 comprises a male housing 30 made of an insulating material and four male contacts 40, 40,50 and 50 driven into the male housing 30 from behind and secured thereto. Of the four male contacts 40,40,50 and 50, the outer two contacts 40 and 40 are power supply contacts connected to respective power supply cables 6*a* and 6*a*, and the inner two contacts 50 and 50 are signal contacts connected to respective signal cables 6*b* and 6*b*. The male connector 3 includes a front end portion 3*a*, a neck portion 3*b* and a base portion 3*c* located at the rear end of the connector.

The male housing 30, on its own part, has a housing front end section 30 a that operates as the connector front end portion 3*a*, a housing neck section 30*b* that operates as the connector neck portion 3*b* and a housing neck section 30*c* that operates as the connector base section 3*c*. The housing front end section 30*a* is made to protrude upwardly and provided on the upper surface thereof with four line contact holding grooves 33, 33, 33 and 33 that are arranged in so many rows and at the front end of on the lower surface with an insertion guide surface 31 that is formed by chamfering the lower front end of the housing 30. The housing neck section 30*b* is a downwardly recessed section, extending downwardly aslant from the housing front end section 30*a* as a whole. The housing base section 30*c* is also made to protrude upwardly and provided with four contact insertion holes 34, 34, 34 and 34 in so many rows, running from the rear end of the housing 30 to the top source of the housing neck section 30*b*. Each of the contact insertion holes, 34,34,34 and 34 is provided at a position located close to the front end of the top surface with a resilient arm 35 for holding the lance 44 or 54 of the corresponding male contact 40 or 50, whichever appropriate, as will be described hereinafter. The male housing 30 is also provided on the bottom surface with a pair of semispherical lock projections 32 and 32.

The male contacts 40, 40, 50 and 50 are adapted to be driven into the corresponding respective contact insertion holes 34,34,34 and 34, and secured to the male housing 30. They are provided at the front ends thereof with respective male contact sections 41, 41, 51 and 51, which are inserted into the respective contact holding grooves 33,33,33 and 33. However, as seen from FIG. 4, while the male contact sections 41 and 41 of the power supply contacts 40 and 40 extend almost to the front end of the male housing 30, the male contact sections 51 and 51 of the signal contacts 50 and 50 extend only to a position relatively retreated from the front end of the male housing 30. This difference of the front end positions of the contact sections 41, 41, 51 and 51 allows a time lag of connection. It is notable that the power supply contacts 40, 40 and the signal contacts 50 and 50 differ from each other only in terms of the length of the male contact sections 41 and 41, and that of the male contact sections 51 and 51. Otherwise, they show the same profile.

A contact neck section 42 (52) extends from the rear end of each of the male contact section, or the contact section 41 or 51 and is arranged on the housing neck section 30*b*. A contact base section 43, (53) extends from the rear end of the contact neck section 42 (52) and is provided with a lance 44 (54), a core press section 45 (55) and a coat holding section 46(56). The core press section 45 (55) presses the core of the corresponding cable 6*a* to establish an electric connection between the male contact 40 (50) and the core of the power supply wire 6*a*. The coat holding section 45 (56) holds the power supply wire 6*a* to firmly link the male contact 40 (50) and the power supply wire 6*a*.

When the male contact 40 (50) is driven into the contact insertion hole 34 from the rear side of the male housing 30, the lance 44 (54) is forcibly pushed downward and forced into the contact insertion hole 34. Then, when the lance 44 (54) emerges out of the contact insertion hole 34, it restores its proper profile and projects upward to adojoin the corresponding resilient arm 35 of the male housing 30 and prevent the male contact 40 (50) from being pulled backward. At the same time, the male contact 41 (51) is forcibly put into the corresponding contact holding groove 33 and securely held there, while the contact neck section 42 (52) is located on the housing neck section 30*b* so that the male contact 40 (50) is rigidly secured to this position.

Figure 6:
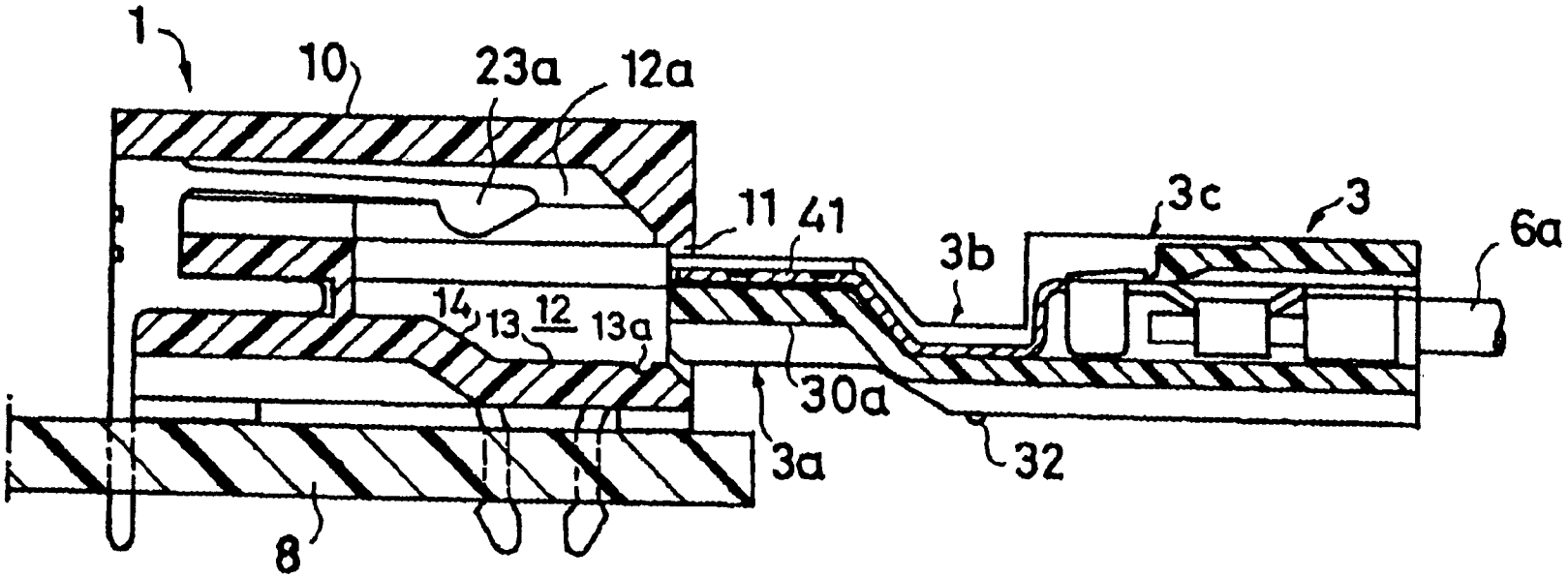
FIG. 6 is a schematic cross sectional view of the embodiment of FIG. 1, showing a step of engagement of the female connector and the male connector.
Figure 7:
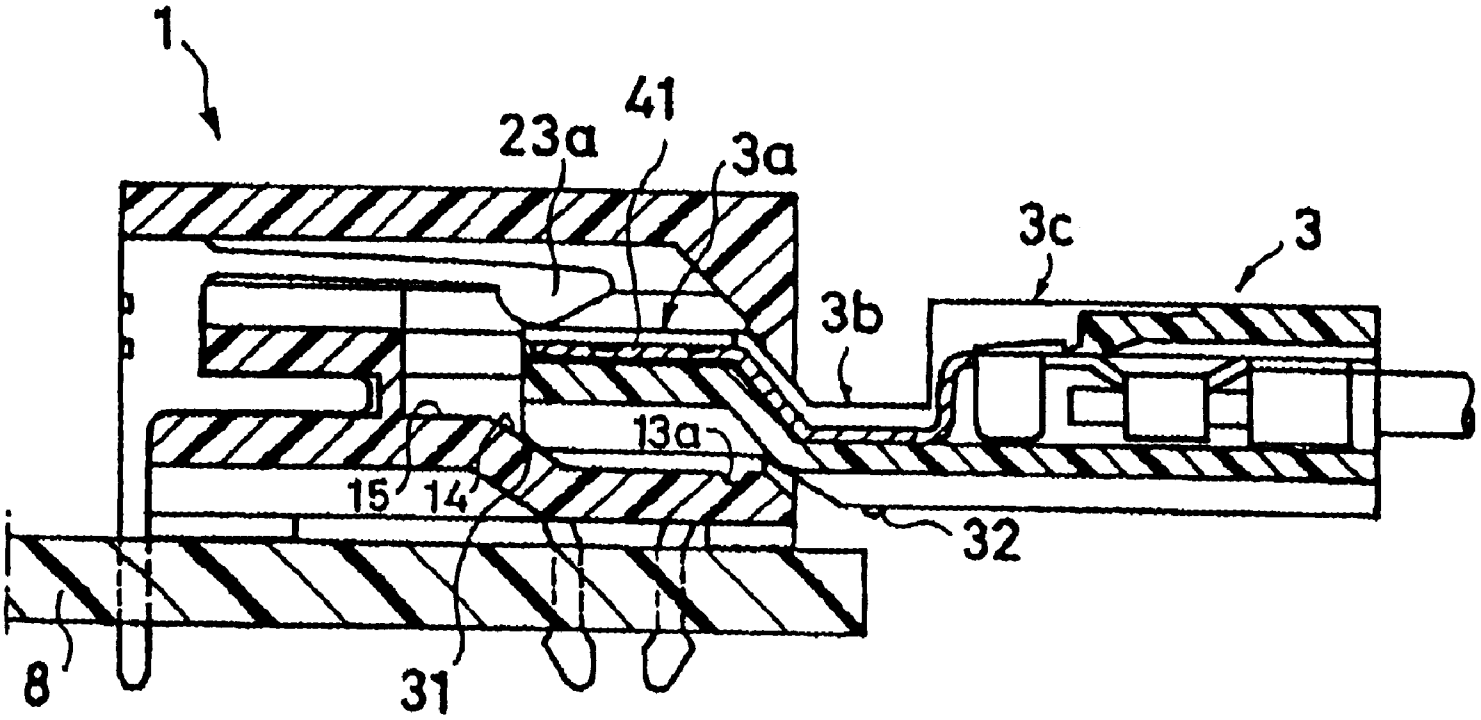
FIG. 7 is a schematic cross sectional view of the embodiment of FIG. 2, showing another step of engagement of the female connector and the male connector.

Now, the operation to bring the female connector 1 and the male connector 3 having the above described configurations into mutual engagement will be discussed below, referring to FIGS. 6 through 9. This engagement is realized when the front end portion 3*a* of the male connector 3 is inserted into the engagement space 12 through the insertion opening 11 of the female connector 1 that is fitted to a printed circuit board 8 as shown in FIG. 6. The connector front end portion 3*a* is so dimensioned as to be apt to pass through the insertion opening 11. Thus, when the connector front end portion 3*a* is put into the insertion opening 11, the bottom surface of the housing front end section 30*a* is guided by the upper surface of the horizontal section 13 to move straight backward.

Then, when the insertion guide surface 31 at the lower front end of the housing front section 30*a* adojoins the guide section 14, it moves aslant upward and backward along the sloped surface of the guide section 14 to move the connector front end portion 3*a* also in that direction. While the connector neck portion 3*b* is located in the insertion opening 11 at this time, it can also move aslant upwardly and backward in the insertion opening 11 to follow the movement of the connector front end portion 3*a* due to its vertically recessed and obliquely extending profile.

Figure 8:
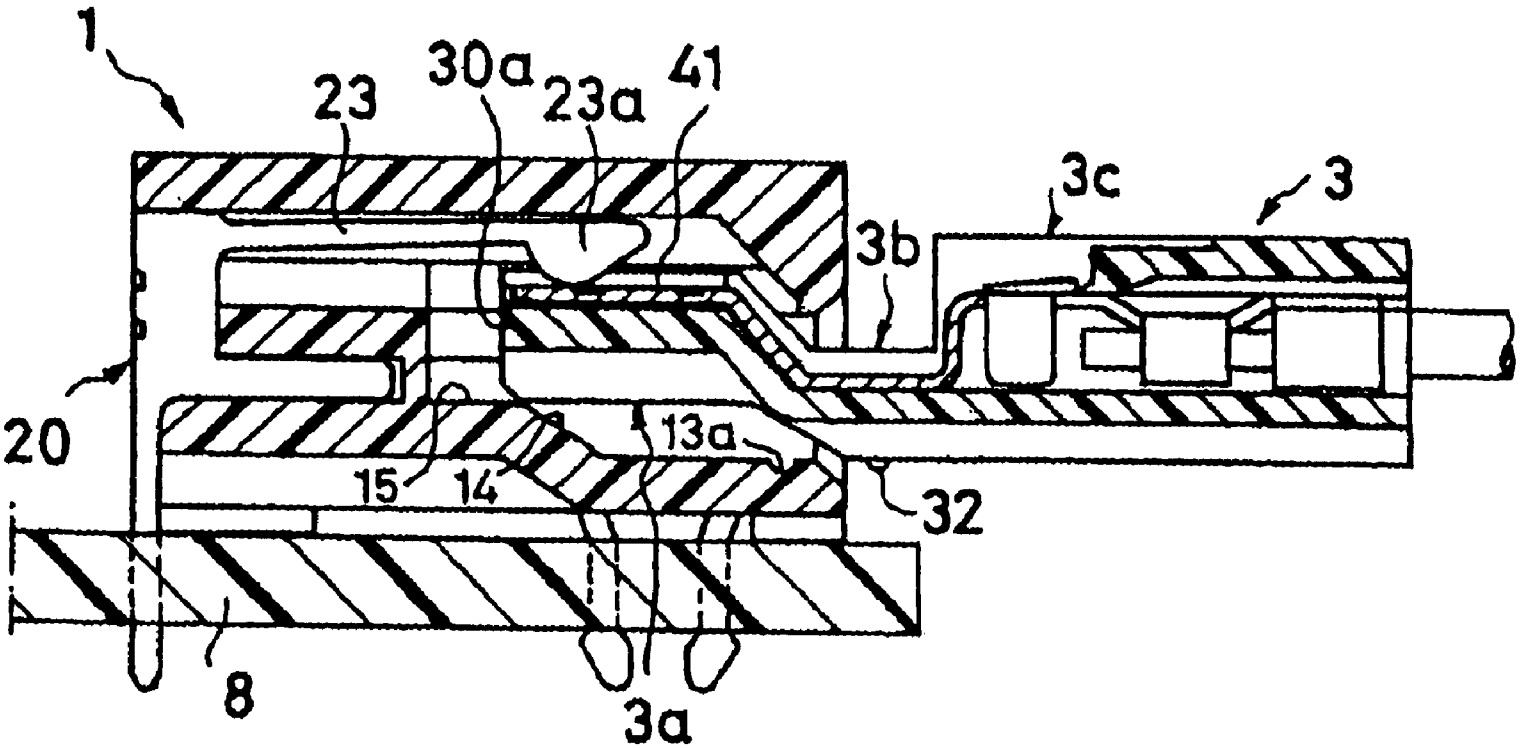
FIG. 8 is a schematic cross sectional view of the embodiment of FIG. 2, showing still another step of engagement of the female connector and the male connector.

When the insertion guide surface 31 moves along the guide section 14 and the housing front end section 30*a* advances aslant upwardly, the male contact sections 41, 41, 51 and 51 of the male contacts 40, 40, 50 and 50 come to join the corresponding respective female contact sections 23*a*, 23*a*, 23*a* and 23*a* of the female contacts 2,20, 20 and 20. It is notable that at this time, the male contact sections 41 and 41 of the power supply contacts 40 and 40 join the corresponding respective female contact sections 23*a* and 23*a* first and subsequently the male contact sections 51 and 51 of the signal contacts 50 and 50 come to contact the corresponding respective female contact sections 23*a* and 23*a* with a time lag. With this arrangement, the power lines are connected before the connection of the signal lines to prevent any possible adverse effect on the electronic components arranged on the printed circuit board 8. When the movement of the insertion guide surface 31 along the guide section 14 is terminated, the lower surface of the housing front section 30*a* rides on the horizontal holding section 15 as shown in FIG. 8.

Figure 9:
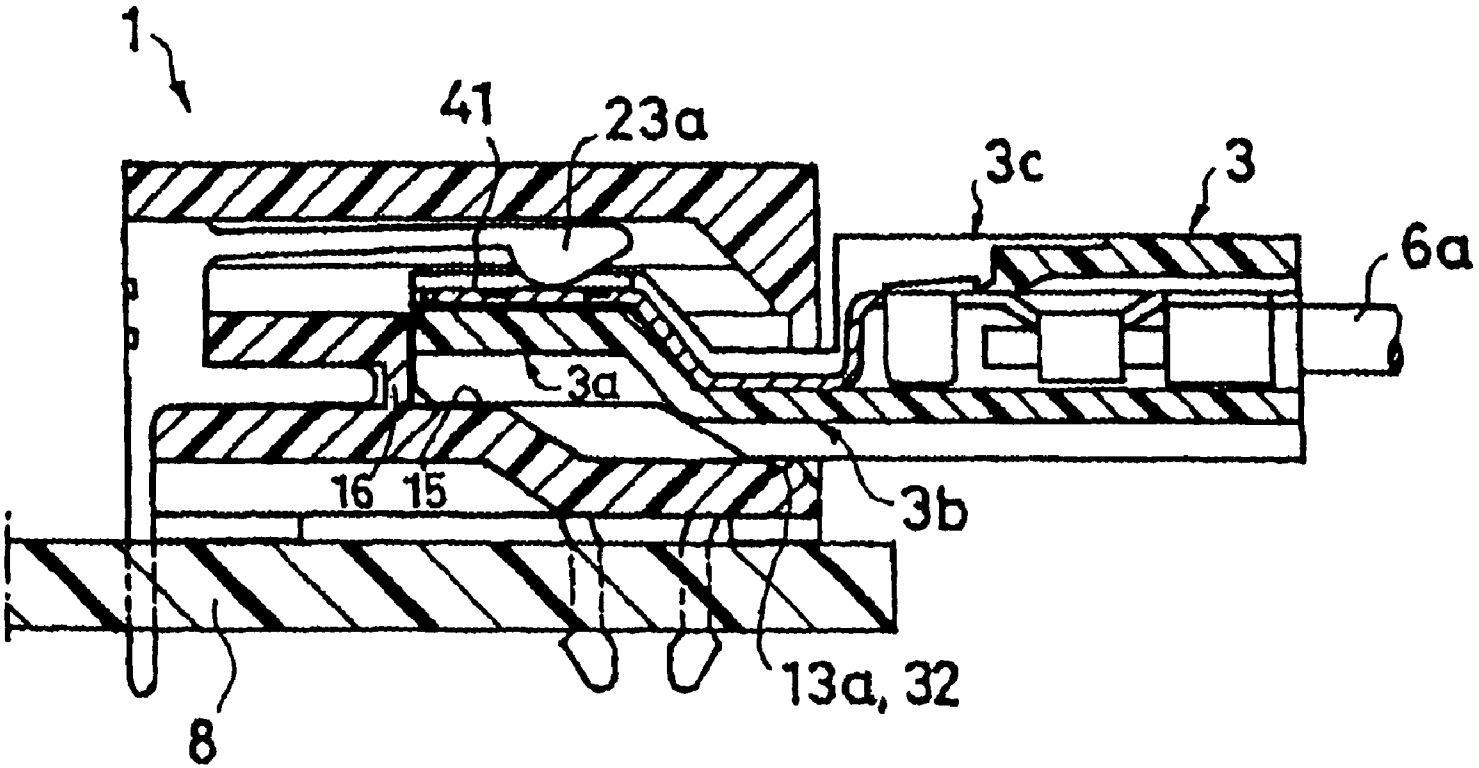
FIG. 9 is a schematic cross sectional view of the embodiment of FIG. 2, showing still another step of engagement of the female connector and the male connector.

When the male connector 3 is inserted further, the connector front end portion 3*a* adjoins the rear partition wall 16 at the position shown in FIG. 9 where the operation of inserting the male connector is completed. Until this time, the lower surface of the housing front end section 30*a* moves horizontally on the holding section 15 and the contact between the female contacts 23*a*, 23*a*, 23*a* and 23*a* of the female contacts 23, 23, 23 and 23 and the corresponding respective male contact sections 41, 41, 51, 51 of the male contacts 40, 40, 50 and 50 is maintained. At the position where the operation of inserting the male connector is completed, the lock projections 32 and 32 formed on the bottom surface of the male housing 30 are received in the corresponding respective lock recesses 13*a* and 13*a* formed on the horizontal section 13 of the female housing 10 to lock the connectors 1 and 3 relative to each other. The user inserting the male connector into the female connector has a feeling of click when the lock projections 32 and 32 are received in the lock recesses 13*a* and 13*a* so that he or she can realize the completion of the mutual engagement process.

As is understood from the above description, while the insertion opening 11 of the female connector 1 is open at the front end thereof when it is fitted to a printed circuit board 8 and the matching male connector 3 is not connected to it, the female connectors 20, 20, 20 and 20 are totally invisible from the front side of the insertion opening 11. Therefore, it is extremely improbable that a metal rod is put into the female connector 1 and toutchs any of the female contacts 20, 20, 20 and 20 so that the electronic components arranged on the printed circuit board 8 is free from such accidents and resultant adverse effects.

Figure 10:
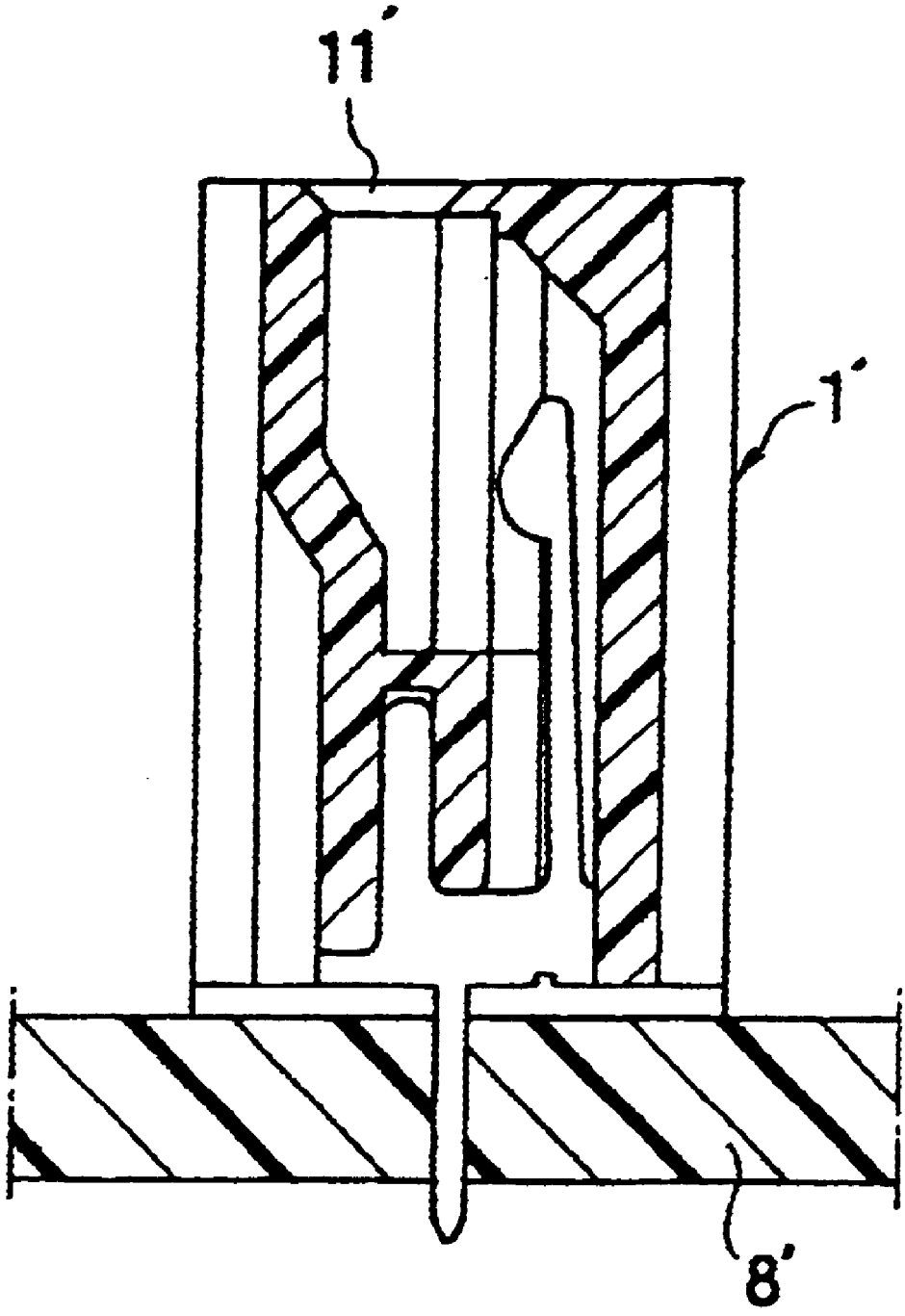
FIG. 10 is a schematic cross sectional view of the female connector of another embodiment male-female engagement type connector set according to the invention.

While wires 6*a*, 6*a*, 6*b* and 6*b* are directly fitted to the male connector 3 in the above described embodiment, the male connector may alternatively be fitted to some other printed circuit board. Still alternatively, as shown in FIG. 10, the female connector 1' may be uprightly fitted to a printed circuit board 8' and the insertion opening 11' may be directed upward.

As described above, according to the invention, since the contact section of a female connector according to the invention is arranged in the engagement space thereof at a position shifted toward the outer periphery so that it is not visible from the front side of the insertion opening, if the front end of a screw driver is put into the female connector through the insertion operation by mistake, it would not touch the contact section of the female connector to adversely affect any of the electronic components arranged on the printed circuit board to which the female connector is fitted. Additionally, since the connector is provided with a guide section for guiding the matching connector inserted into the engagement space through the insertion opening to move toward and adojoin the contact section, the contact section of the matching connector can reliably join its counterpart of the connector according to the invention to establish a reliable electric connection therebetween simply by inserting the matching connector into the engagement space through the insertion opening.

Preferably, a connector according to the invention further comprises a holding section for holding the matching connector inserted into the engagement space of the housing member to a moved state toward the contact section thereof. Then, the contact section of the matching connector can reliably join its counterpart of the connector according to the invention to establish a reliable electric connection therebetween simply by inserting the matching connector into the engagement space through the insertion opening and, at the same time, maintain the electrically connected state due to the provision of the holding section.

With a male-female engagement type connector set according to the invention, since the female contact section is arranged in the engagement space at a position shifted toward the outer periphery so as to be invisible from the front side of the insertion opening, if the user inserts by mistake a screw driver through the insertion opening, the front end of the screw driver would not join the female contact section to adversely affect any of the electronic components arranged on the substrate to which the female connector is fitted Additionally, since a male-female engagement type connector set according to the invention is provided with a guide section for guiding the front end of the male connector inserted into the engagement space through the insertion opening so as to make it move toward and adojoin the female contact section, the contact section of the male connector can reliably abut its counterpart of the female connector to establish a reliable electric connection therebetween simply by inserting the male connector into the engagement space through the insertion opening.

Preferably, a male-female engagement type connector set according to the invention further comprises a holding section arranged in the female housing member for holding the front end portion of the male connector inserted into the engagement space of the housing member to a moved state toward the female contact section. Then, the contact section of the male connector can reliably be moved toward and abut its counterpart of the female connector to establish a reliable electric connection therebetween simply by inserting the male connector into the engagement space through the insertion opening and, at the same time, maintain the electrically connected state due to the provision of the holding section.

Preferably, a male-female engagement type connector set according to the invention further comprises a lock means for locking and holding the male housing member relative to the female housing member at a position where the front end of the male connector is completely inserted into the engagement space. At the position where the front end portion of the male connector is completely inserted into the engagement space, the state in which the male contact section abut the corresponding female contact section to establish a reliable electric connection therebetween is maintained by the holding section. Therefore, as the male connector is locked to this position by the lock means, the state of the male connector being held by the holding section becomes further reliable. Additionally, as the locking operation of the lock means is accompanied by a feeling of click, the user can easily feel the completion of the insertion of the male connector.

Preferably, in a male-female engagement type connector set according to the invention, the male connector has a plurality of male contact members provided at the front ends thereof with respective male contact sections that are arranged transversely and exposed and the front end position of the male contact section of the other male contact members is displaced from the front end position of the male contact section of the other male contact members along the direction of insertion so that the male contact members are connected with the respective female contact members with a time lag. With this arrangement, when the male connector is connected to the female connector, the grounding contact member and the power supply contact member of the male connector may be connected first with their respective counterparts of the female connector and the signal contact members of the male connector may be connected subsequently with their respective counterparts of the female connector to give rise to a time lag for electric connection. Then, any possible adverse effect on the electronic components on the related electronic connected by way of the connectors can be minimized.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A connector assembly comprising:

a housing having a front end and an insertion opening formed at said front end, said housing being made of an insulating material forming an internal engagement space in communication with said insertion opening, and having a guide section to connect said housing to said front end;

a matching connector inserting in a linear manner through said insertion opening formed at the front end thereof;

a contact member fitted to said housing and having a contact section arranged in the internal engagement space of said housing, and operative to move toward an outer periphery of said housing, said contact section being arranged in the internal engagement space at a position shifted toward the outer periphery so as to be away from the insertion opening; and a guide section, positioned in said housing between said engagement space and said contact section, for guiding the matching connector inserted into the engagement space through the insertion opening to move toward and adjoin the contact section.

2. The connector assembly according to claim 1, and further comprising:

a holding section for holding the matching connector inserted into the engagement space of said housing to a position towards contact section.

3. A male-female engagement type connector set comprising:

a male connector having a male contact member provided with a male contact section and held in a male housing with said male contact section exposed at a front end thereof;

a female connector having a female housing made of an insulating material and provided with an insertion opening, and said female housing having an internal engagement space, in communication with said insertion opening, receiving said front end of said male connector inserted through said insertion opening in a linear manner;

a female contact member fitted to said female housing with a female contact section arranged internally in said engagement space to move toward an outer periphery of said female housing, with said contact section being arranged in said engagement space at a position away from the insertion opening;

a guide member being an upwardly extending ramp positioned in said female housing between said engagement space and said female contact section for guiding the front end of said male connector inserted into the engagement space through the insertion opening to move toward said female contact section and cause said male contact section to adjoin the corresponding female contact section; and said male connector having a neck portion extending from said front end of said male connector and a base portion extending from said neck, said male connector having said front end adapted to be inserted into said engagement space of said female housing; and said male connector being profiled so as to make said neck portion located in said insertion opening when assembled in said female connector and said front end free from obstruction when inserted into said engagement space and guided by said guide member toward said female contact section.

4. The male-female engagement type connector set according to claim 3, and further comprising:

a holding section arranged in the female housing member for holding said front end of the male connector inserted into the engagement space of said female housing member to a towards the female contact section.

5. The male-female engagement type connector set according to claim 4, and further comprising:

a lock for locking and holding the male housing member relative to the female housing at a position where the front end of the male connector is completely inserted into said holding section.

6. The male-female engagement type connector set according to claim 3, wherein the male connector further comprises:

a plurality of male contact members provided at the front ends thereof with respective male contact sections that are arranged transversely and exposed, and the front end position of the male contact section of at least one of the male contact members is displaced from the front end position of the male contact section of a remainder of said plurality of male contact members along a direction of insertion so that the male contact members are connected with the respective female contact members.

7. A connector for connecting at least one cable to a printed circuit board, said connector comprising:

a female housing made of an insulating material and having a front end insertion opening, a rear section, and an internal engagement space between said insertion opening and said rear section, said internal engagement space including a horizontal section positioned near said insertion opening and a ramping section extending away from said horizontal section and into said rear section;

a contact member fitted to said rear section of said female housing, a contact arm extending from said contact member and into said horizontal section above said ramping section and away from said insertion opening, a holding arm extending from said contact member, and a lead section for electrically connecting said contact member to said printed circuit board; and a matching male connector having a male housing base section receiving the at least one cable and a core press section for establishing an electrical connection with the at least one cable, a front end section having a male contact section and entering said insertion opening of said female housing in a linear manner, a contact neck section having an upwardly extending ramp to connect said housing base section to said front end with said ramp of said contact neck matching said ramping section of said female housing to position said male contact section in electrical contact with said contact arm of said contact member in said horizontal section of said female housing away from said insertion opening.

8. The connector according to claim 7, wherein said ramping section having said guide member for guiding the matching male connector inserted into the internal engagement space of the female housing up the rear ramping section to a holding position between the contact member and an upper space of said female housing.

9. A female connector for connecting at least one cable to a printed circuit board, said female connector comprising:

a female housing made of an insulating material and having a front end insertion opening and a rear section, said female housing forming an internal engagement space between said insertion opening and said rear section receiving a male connector in a linear manner, said internal engagement space including a horizontal section positioned near said insertion opening and a rear ramping partition wall extending away from said horizontal section, and a holding section extending upwardly away from said rear ramping partition wall and into said rear section to define an upper space;

a contact member fitted to said rear section of said female housing member, a contact arm extending from said contact member for entering into said upper space above said rear ramping partition wall and away from said insertion opening, a holding arm extending from said contact member into said holding section, and a lead section for electrically connecting said contact member to said printed circuit board; and at least two anchor fittings for securing said female housing by extending through said female housing and into the printed circuit board.

10. The connector according to claim 9, wherein said rear ramping partition wall includes;:

a guide member guiding a matching male connector inserted into the internal engagement space of the female housing up the rear ramping section to a position between the contact member and the upper space of said female housing.

11. A connector for connecting at least one cable to a printed circuit board, said connector comprising:

a female housing made of an insulating material and having an insertion opening, a holding section, a contact member fitted to a rear of said housing, and an internal engagement space between said insertion opening and said holding section, said internal engagement space including a ramping section;

a matching male connector including a housing base section receiving at least one cable and a core press section establishing an electrical connection with the at least one cable, a front end having a male contact section and entering said insertion opening of said female housing in a linear manner, and an upwardly extending contact section which substantially matches said female housing ramping section to position said male contact section in said female housing holding section away from said insertion opening.

12. The connector for connecting at least one cable to a printed circuit board according to claim 11, and further comprising:

a lead section for electrically connecting said contact member to said printed circuit board.

13. The connector for connecting at least one cable to a printed circuit board according to claim 12, and further comprising:

a lock for locking and holding the male front end in the female housing when the front end of the male connector is completely inserted into the engagement space.

14. The connector for connecting at least one cable to a printed circuit board according to claim 12, wherein the male connector further comprising:

a plurality of male contact members positioned at the front end and arranged transversely and exposed to the front end of the male contact section, said at least one male contact member being displaced from the front end of the male contact section of the other male contact members in a direction of insertion.

15. The connector for connecting at least one cable to a printed circuit board according to claim 12, wherein said connector further comprising:

a contact arm extending from said contact member for entering into said upper space above said rear ramping partition wall and away from said insertion opening, a holding arm extending from said contact member into said holding section, and a lead section for electrically connecting said contact member to said printed circuit board.

16. A connector for connecting at least one cable to a printed circuit board, said connector comprising:

a female housing having an insertion opening, a holding section, and an internal engagement space between said insertion opening and said holding section, said internal engagement space including a ramping section;

a matching male connector including a housing base section receiving at least one cable and a core press section establishing an electrical connection with the at least one cable, a front end having a male contact section and entering said insertion opening of said female housing in a linear manner, and an upwardly extending contact section which substantially matches said female housing ramping section to position said male contact section in said female housing holding section away from said insertion opening; and a contact member fitted to said rear ramping section of said female housing, a contact arm extending from said contact member for entering into said internal engagement space above said rear ramping section and away from said insertion opening, a holding arm extending from said contact member into said holding section for locking and holding the male front end in the female housing when the front end of the male connector is completely inserted into the engagement space.

* * * * *